US006592365B1

(12) United States Patent
Johns

(10) Patent No.: US 6,592,365 B1
(45) Date of Patent: Jul. 15, 2003

(54) SEAL FOR OVEN CIRCULATING FAN

(76) Inventor: Clifford L. Johns, 2614 Evergreen Wynde, Louisville, KY (US) 40223

( * ) Notice: Subject to any disclaimer, the term of this patent is extended or adjusted under 35 U.S.C. 154(b) by 0 days.

(21) Appl. No.: 10/162,093

(22) Filed: Jun. 4, 2002

Related U.S. Application Data

(60) Provisional application No. 60/297,227, filed on Jun. 8, 2001.

(51) Int. Cl.[7] ..... F27B 7/24

(52) U.S. Cl. ..... 432/244; 292/307 R; 277/358; 277/390; 277/391

(58) Field of Search ..... 432/115, 244; 429/172; 292/307 R, 317, 327, 325, 324; 277/409, 500, 908, 507, 358, 390, 391

(56) References Cited

U.S. PATENT DOCUMENTS 5,913,521 A * 6/1999 Sangren et al. ..... 277/372
5,967,525 A * 10/1999 Sandgren et al. ..... 277/370
6,254,102 B1 * 7/2001 Vicory, Sr. ..... 277/390
6,406,074 B1 * 6/2002 Mahaney ..... 292/327
6,457,720 B1 * 10/2002 London ..... 277/370
6,485,023 B2 * 11/2002 Budrow et al. ..... 277/370

* cited by examiner

*Primary Examiner*—Gregory Wilson
(74) *Attorney, Agent, or Firm*—Camoriano and Associates; Theresa Fritz Camoriano; Guillermo E. Camoriano

(57) ABSTRACT

A multiple-piece seal is used for a cure oven circulating fan. The seal may be readily positioned along the length of the shaft to control the small clearance between the rotating seal and the oven such that there is no contact between the seal and the oven, but the flow of heated air from the oven is substantially reduced and redirected away from the bearings of the circulating fan. The multiple-piece design permits seal replacement without having to disassemble the shaft, so that the seal may be replaced entirely from the outside of the oven, saving substantial down-time.

8 Claims, 4 Drawing Sheets

SEAL FOR OVEN CIRCULATING FAN

This application claims priority from U.S. Provisional Patent Application Serial No. 60/297,227 filed on Jun. 8, 2001.

BACKGROUND OF THE INVENTION

The present invention relates to seals, and in particular to a seal for use on a shaft of a circulating fan in a paint cure oven.

Modem automobile and truck body protective coatings are applied as the body passes through a series of coating dip and spray booths and ovens. Coatings are set or initially cured in ovens that include the radiant heat type. Radiant heat ovens have a conveyor that runs the length of the oven to allow the bodies to move from one end of the oven to the other. Radiant heating is achieved by burning natural gas in an interior plenum to the oven. The inner oven side surfaces along the length of conveyor are heated by natural gas. This heated surface then radiates heat toward the body to be cured as it travels along on the conveyor.

The oven can be composed of one or more zones (up to 7 is common), each of which can be temperature controlled. Zone heating is used to ensure the quality of the coating. Circulating fans are used to prevent stratification of the heated air in the oven. If stratification were to occur, it could cause variations in the coating cure, which would produce a product of unacceptable quality due to over-cured coatings on upper portions of a vehicle body (hotter) and under-cured coatings on lower portions and in recessed areas of a vehicle body (cooler). Efficient oven operation is obtained with continuous and extended operation, which increases the need for ease of maintenance. Oven temperatures can range from ambient to over 350° F.

The circulating fan includes a shaft-mounted impeller, which is driven by an electric motor using V-belts and sheaves. The shaft position is maintained by roller bearings, with the motor, belts, sheaves and bearings all supported on a common frame which is secured to the top of the oven. The fan impeller and part of the fan shaft extend vertically through the top of the oven, with the fan shaft passing through a pipe that is secured to, and extends above, the top of the oven. The outer shell of the oven is insulated for thermal efficiency and to prevent damage to various parts.

The pipe through which the fan shaft enters the oven acts as a chimney, drawing hot air from inside the oven and directing it upwardly where the hot air contacts the bearings, drying out the lubricant in the bearings and leading to premature failure. Also, any dirt flying around the shaft area, such as wear pieces from the V-belt drive, may fall through the clearance gap between the shaft and the pipe and into the oven area, possibly contaminating the finish on the pieces being cured inside the oven.

SUMKARY OF THE INVENTION

The present invention proposes the use of a split-boot seal which clamps around the shaft and caps off the pipe through which the shaft extends, substantially reducing the release of heat from the oven.

The seal of the present invention also redirects the flow of heated air which does escape from the oven via the pipe so that the heated air is no longer directed onto the bearings, thus further increasing the life of the bearings on the fan drive.

The seal of the present invention is of a two-piece design so it may be readily replaced from outside of the curing oven simply by releasing a clamp, removing the old seal halves, installing new seal halves, and reinstalling the clamp. This seal replacement takes minutes to complete, compared with the hours required to replace a traditional seal which involves entering the confined space of the main oven cavity to disassemble the shaft (and consequently the need to cool down the oven completely before any replacement work can be started).

The ease with which the seal of the present invention may be replaced, the fact that this seal substantially reduces the escape of heated air from the oven, and the fact that the heated air which does escape is effectively directed, by the seal, away from the bearings, results in cooler running bearings and permits the use of standard, off-the-shelf bearings instead of special, high temperature bearings for this application.

The seal of the present invention is secured to the fan shaft using a clamp and is located directly above the pipe passing through the oven. There is a gap between the seal and the top of the oven such that the seal does not contact any stationary oven part when the fan is in operation.

DESCRIPTION OF THE PREFERRED EMBODIMENT

Figure 1:
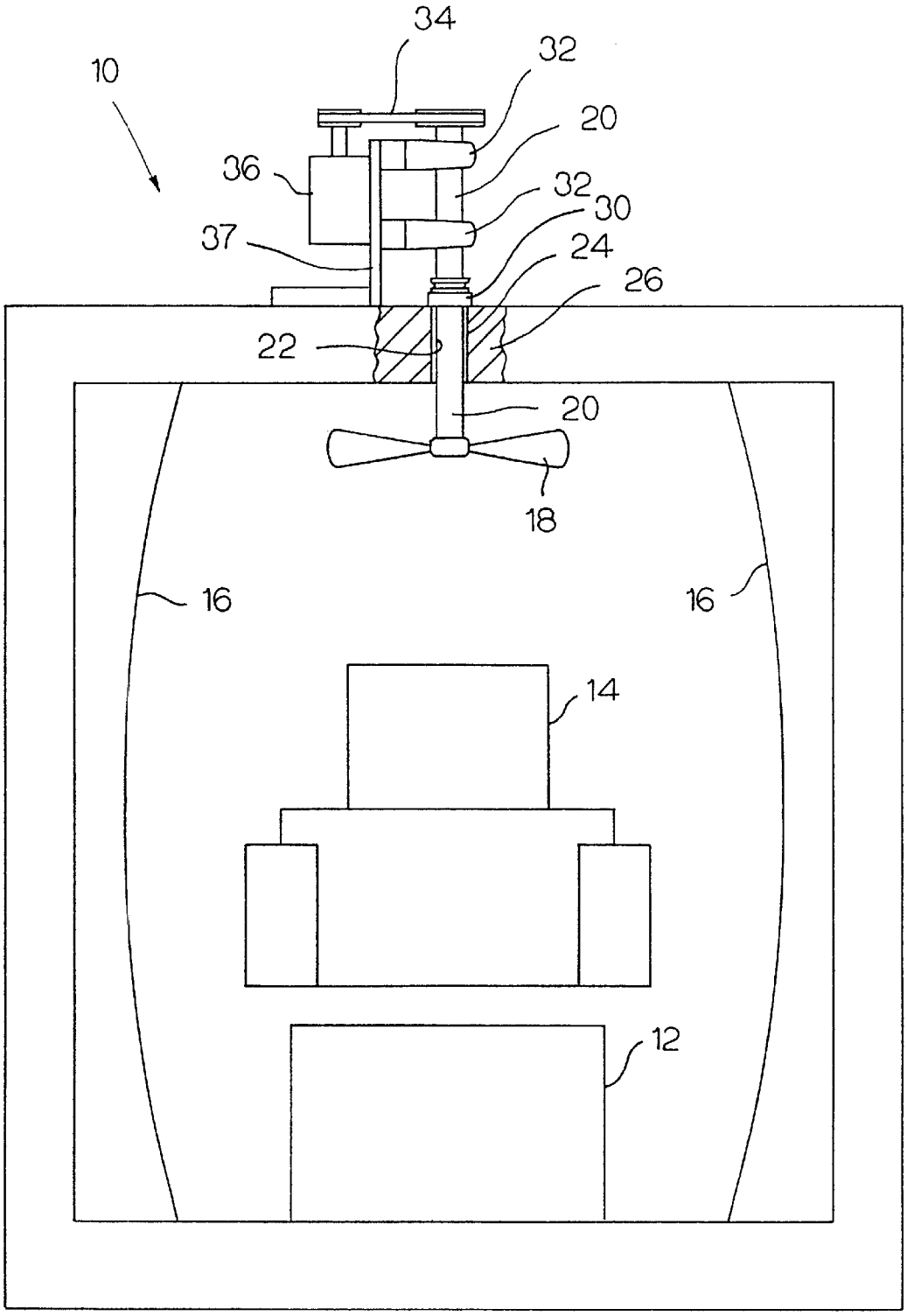
FIG. 1 is a schematic, sectional view of a paint curing oven made in accordance with the present invention.

FIG. 1 shows a sectional view of a paint curing oven 10 including a conveyor 12 that runs the length of the oven to move components 14 from one end of the oven 10 to the other. The inner oven side surfaces 16 along the length of the conveyor 12 are heated, typically by natural gas burners, and this heat is then radiated toward the components 14 to be cured as they travel along the conveyor 12. Circulating fans 18 are used to prevent stratification of the air inside the oven 10. Since warm air naturally rises, without the circulating fan 18, cooler air would settle at the bottom of the oven 10, resulting in under-curing of the protective coating in this area, and warmer air would rise to the top of the oven 10, resulting in over-curing of the protective coating in this area.

Figure 2:
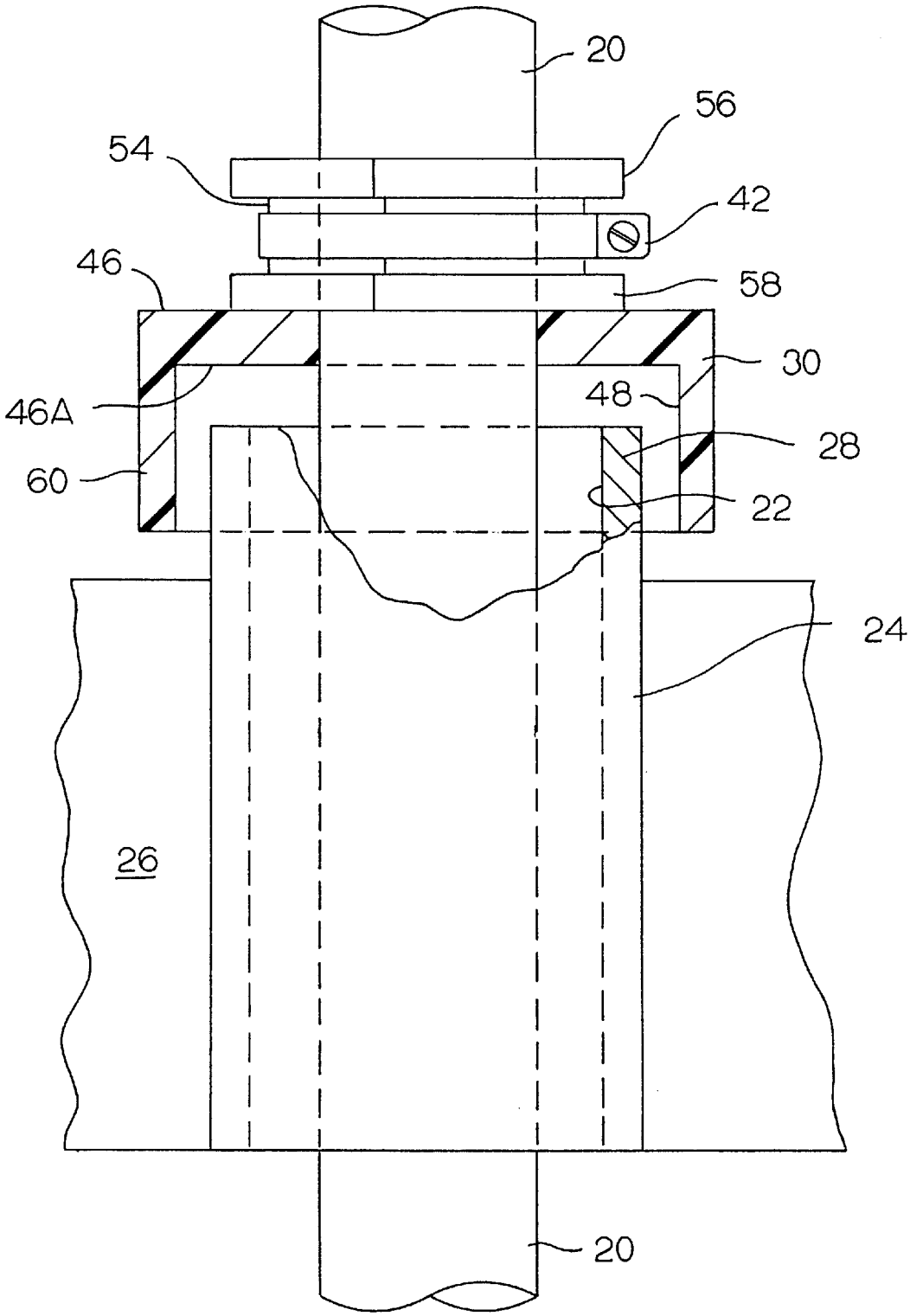
FIG. 2 is a broken away, sectional view of the seal area of FIG. 1.

The fan 18 includes a shaft 20 which enters the oven 10 through an opening 22 created by a hollow pipe 24 which extends through the top wall 26 of the oven 10. A portion 28 of the pipe 24 extends and projects above the top wall 26 of the oven 10 (as shown in FIG. 2). A two-piece, split-boot seal 30 is secured to the shaft 20 and caps the projecting portion 28 of the pipe 24 as will be discussed shortly. Outside the oven 10, the shaft 20 is rotationally supported by bearings 32. A V-belt drive arrangement 34 links the shaft 20 to a motor 36, which drives the shaft 20 and the fan 18. The motor 36, the V-belt drive 34, and the bearings are mounted in a housing 37.

Figure 3:
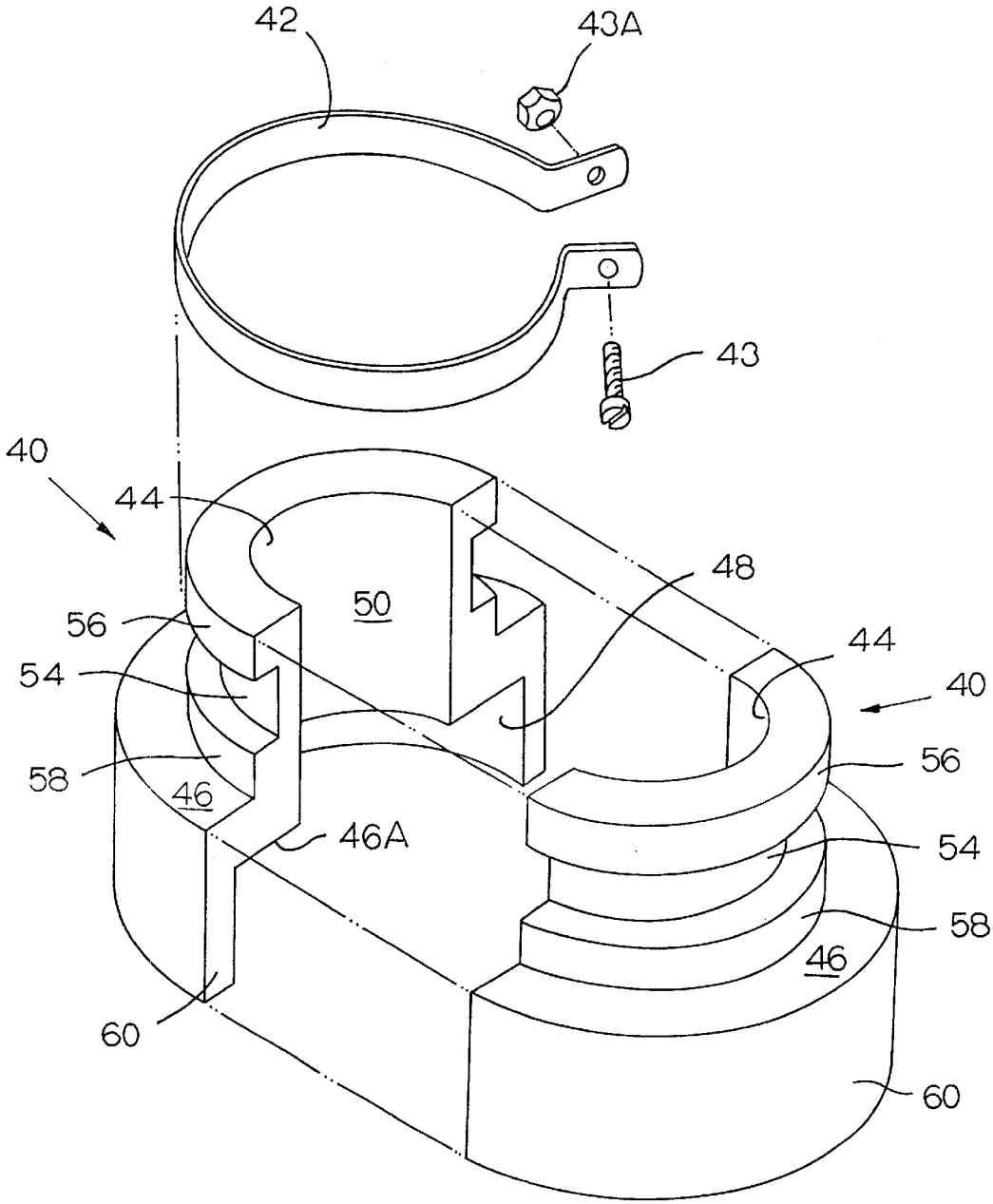
FIG. 3 is an exploded, perspective view of the seal of FIG. 2.
Figure 4:
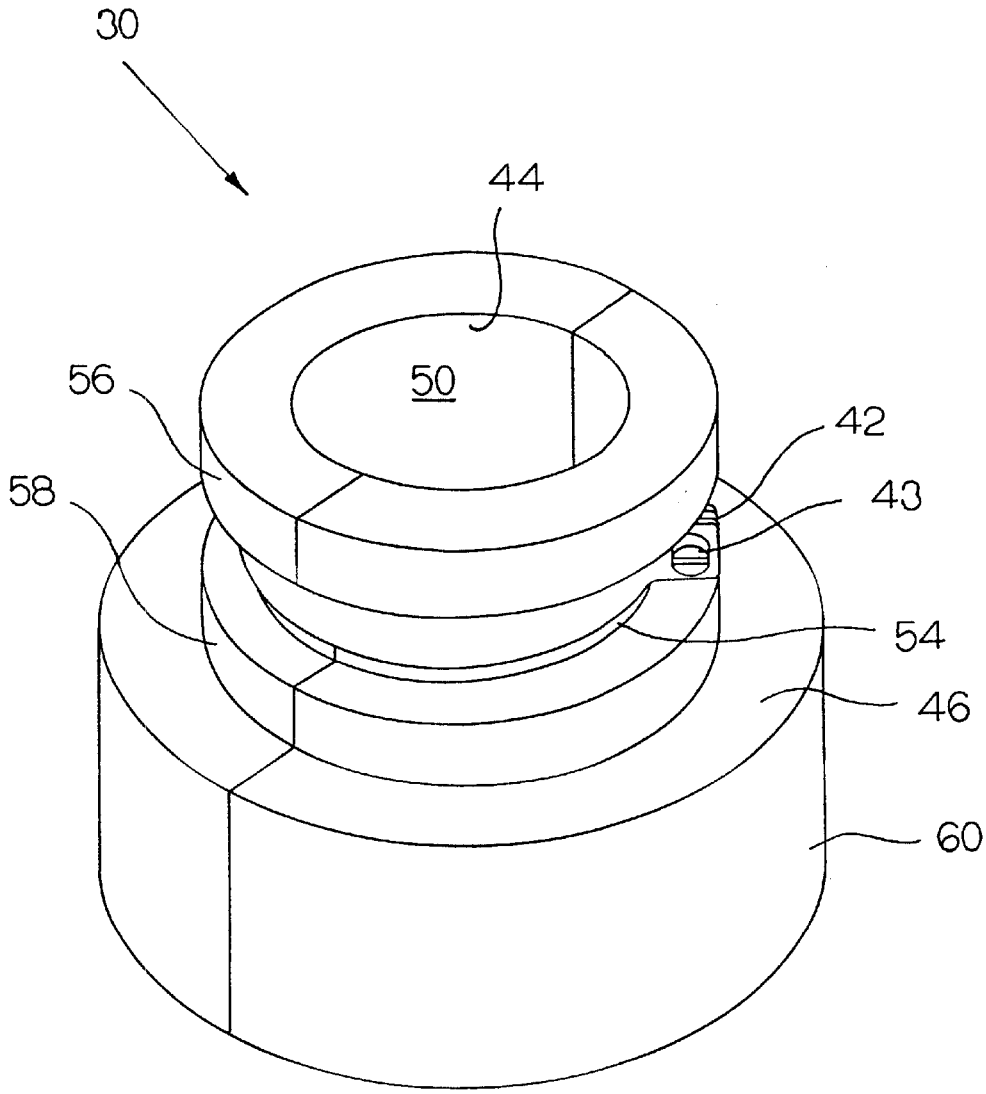
FIG. 4 is an assembled, perspective view of the seal of FIG. 3.

Referring now to FIG. 3, the seal 30 is shown in more detail. The seal 30 includes two symmetrical half sections 40 which, when secured with a suitable clamp 42, form a seal having a substantially circular cross-section. Once assembled (See FIG. 4), the interior surface of the seal 30 defines a first, smaller diameter cylindrical section 44, which is connected via a flange 46 to a second, larger diameter cylindrical section 48. The first cylindrical section 44 has an inside surface 50 with a nominal inside diameter which is substantially equal to the outside diameter of the shaft 20. The outside surface of this first cylindrical section 44 includes an annular indentation 54 between two projections 56, 58. This indentation 54 receives the clamp 42 such that, when the seal halves 40 are assembled onto the shaft 20 to form the seal 30, the clamp 42 holds the seal halves 40 together and further clamps the seal 30 onto the shaft 20, sealing against any flow of heated air axially along the shaft 20.

The larger diameter interior cylindrical section 48 has a larger inside diameter than that of the smaller diameter cylindrical section 44. The inside diameter of the larger diameter cylindrical section 48 is slightly larger than the outside diameter of the pipe 24, and the seal 30 is positioned on the shaft 20 such that this larger diameter section 48 forms a skirt 60 around the top portion 28 of the pipe 24, as shown in FIG. 2. The length of the skirt 60 is preferably approximately equal to the height of the top portion 28 of the pipe 24 that extends above the top wall 26 of the oven 10, so that the large diameter section 48 encloses most of the top portion 28 of the pipe 24.

The placement of the seal 30 along the shaft 20 is adjustable by loosening the nut 43A from the bolt 43 of the clamp 42 and sliding the seal 30 down along the shaft 20 until there is only a small clearance between the bottom of the skirt 60 and the top wall 26 of the oven 10, and then re-tightening the clamp 42 with the nut and bolt 43A, 43 respectively. In this position, and if the length of the skirt 60 is approximately equal to the height of the top portion 28 of the pipe 24 extending above the top wall 26 of the oven 10, then there will also be a small clearance between the top end of the pipe 24 and the inside surface 46A of the flange 46 of the seal 30. Any heated air traveling axially upwardly along the toroidal opening 22 between the shaft 20 and the pipe 24 is forced to make a 90° turn and travel radially outwardly along the first clearance between the top end of the pipe 24 and the inside surface 46A of the flange 46 of the seal 30. The heated air is then forced to make another 90° turn to travel axially downwardly between the skirt 60 of the seal 30 and the outside of the pipe 24. Finally, the heated air must make yet another 90° turn to travel radially outwardly along a second clearance between the bottom of the skirt 60 of the seal 30 and the top wall 26 of the oven 10.

By adjusting the location of the seal 30 on the shaft 20 such that there is a very small clearance between the bottom of the seal's skirt 60 and the top wall 26 of the oven 10, the seal will be free to rotate with the shaft 20 without contacting any stationary part of the oven 10. At the same time, the very small clearances between the seal 30 and the top of the pipe 24 and also between the seal 30 and the top wall 26 of the oven 10 result in a substantial reduction in the amount of heated air allowed to escape from inside the oven 10. Finally, any heated air that does escape past the seal 30 is being directed downwardly and outwardly, away from the bearings 32.

Replacement of the seal 30 is very easy, since the entire seal assembly 30 is located outside of the oven 10, and the two piece design of the seal 30 means that it can be replaced without having to disassemble the shaft 20, bearings 32, drive 34, and so forth. The nut 43A, bolt 43, and the clamp 42 are loosened and removed, and the symmetrical half sections 40 are then readily removable without having to disassemble the shaft. Prior art seals used in is similar applications are of the one-piece design, requiring entering the confined area inside the oven 10 to remove the impeller 18 from the shaft 20, disconnect the V-belt drive 34, and remove the shaft 20 so that the old one-piece seal may be slid off and the new seal may be slid onto the shaft 20, all of which is very time consuming. Thus, the present invention significantly reduces both the labor cost and time required for maintenance to service or replace the seal as part of normal use and operation and permits ease of removal for cleaning and inspection. It also removes the need for confined-space entry, thus improving safety. Finally, since the amount of heated air escaping the oven 10 is substantially reduced, and the heated air which does escape is directed axially away from the bearings 32, the bearings 32 used may be standard off-the-shelf bearings 32 instead of specialty, high-temperature bearings.

The seal 30 is preferably manufactured from a material such as Rulon™ (a high temperature Teflon™) or steel.

It will be obvious to those skilled in the art that modifications may be made to the embodiment described above without departing from the scope of the invention as claimed.

What is claimed is:

1. An oven, comprising:

a heated chamber, defining a top wall, an exterior, and an interior;

an opening through said top wall;

a pipe extending through said opening and including a portion which projects a short distance above the top wall;

a drive shaft extending through said pipe, from the exterior of said heated chamber to the interior of said heated chamber;

a drive mounted on said drive shaft outside of said heated chamber;

a fan mounted on said drive shaft inside of said heated chamber; and a seal mounted on said drive shaft outside of said heated chamber, said seal including two symmetrical halves; said halves together defining a first section having a smaller diameter interior surface and second section having a larger diameter interior surface, and a flange extending between the smaller and larger diameter interior surfaces; wherein said first section defines an external annular indentation; and a clamp received in said annular indentation and clamping said halves together against the shaft;

wherein said larger diameter interior surface surrounds the portion of said pipe which extends above the top wall of the oven.

2. An oven as recited in claim 1, wherein said seal may be axially repositioned along the length of said shaft by loosening said clamp, sliding said seal to a desired location along said shaft and re-tightening said clamp in order to regulate the gap between said seal and said oven in order to restrict the flow of heated air escaping from said oven.

3. A seal and rotating shaft combination, comprising:

a rotating shaft having an outside diameter;

a seal, including a plurality of symmetrical components defining aligned recesses in their exterior surface; and a clamp received in said recesses and clamping said components together against the outside of said rotating shaft, said seal defining a first cylindrical section with an inside diameter substantially equal to the outside diameter of the rotating shaft and a second inside diameter larger than said first inside diameter.

4. A seal and shaft combination as recited in claim 3, wherein said first cylindrical section is connected to said second cylindrical section by a flange.

5. A seal and rotating shaft combination as recited in claim 4, wherein said seal components are two semi-circular cross-section members with abutting edges.

6. An oven, comprising:

a heated chamber, defining a top wall, an exterior, and an interior;

an opening through said top wall;

a pipe extending through said opening and including a projecting portion which projects above the top wall;

a drive shaft extending through said pipe, from the exterior of said heated chamber to the interior of said heated chamber;

a seal mounted on said drive shaft outside of said heated chamber adjacent said top wall, said seal including two axially aligned symmetrical halves, each half having a semi-circular cross-section; said seal halves together defining a first section having a smaller diameter interior surface and a second section having a larger diameter interior surface, and a flange extending between the smaller and larger diameter interior surfaces; wherein said first sections define an external annular indentation; and a clamp received in said annular indentation and clamping the first sections of said halves together against the shaft;

wherein said larger diameter interior surfaces form a skirt around said projecting portion of said pipe.

7. An oven as recited in claim 6, and further comprising a drive mounted to said drive shaft above said seal.

8. An oven as recited in claim 7, and further comprising a fan mounted to said drive shaft inside said heated chamber.

* * * * *

UNITED STATES PATENT AND TRADEMARK OFFICE

CERTIFICATE OF CORRECTION

PATENT NO. : 6,592,365 B1
DATED : July 15, 2003
INVENTOR(S) : Clifford L. Johns

It is certified that error appears in the above-identified patent and that said Letters Patent is hereby corrected as shown below:

Column 1,
Line 11, delete "Modem" and insert therefor -- Modern --.
Line 55, delete "SUMKARY" and insert therefor -- SUMMARY --.

Column 3,
Line 66, delete "is".

Signed and Sealed this

Thirtieth Day of September, 2003

JAMES E. ROGAN
*Director of the United States Patent and Trademark Office*